US005506881A

United States Patent [19]

Ono et al.

[11] Patent Number: 5,506,881

[45] Date of Patent: Apr. 9, 1996

[54] X-RAY TUBE APPARATUS OF A ROTATING ANODE TYPE

[75] Inventors: Katsuhiro Ono, Utsunomiya; Takayuki Kitami, Tochigi, both of Japan

[73] Assignee: Kabushiki Kaisha Toshiba, Kawasaki, Japan

[21] Appl. No.: 334,054

[22] Filed: Nov. 4, 1994

[30] Foreign Application Priority Data

| | | | |
|---|---|---|---|
| Nov. 5, 1993 | [JP] | Japan | 5-276274 |
| Sep. 27, 1994 | [JP] | Japan | 6-230830 |

[51] Int. Cl.[6] ..... H05G 1/02

[52] U.S. Cl. ..... 378/125; 378/131; 378/132

[58] Field of Search ..... 378/125, 119, 378/121, 131, 132, 133, 135, 143, 144

[56] References Cited

U.S. PATENT DOCUMENTS

| | | | |
|---|---|---|---|
| 3,500,097 | 3/1970 | Perry et al. . | |
| 4,247,782 | 1/1981 | Muraki | 378/139 |
| 5,136,625 | 8/1992 | Heiting et al. . | |
| 5,159,697 | 10/1992 | Wirth . | |
| 5,265,147 | 11/1993 | Kim et al. | 378/131 |

FOREIGN PATENT DOCUMENTS

| | | | |
|---|---|---|---|
| 0546532 | 6/1993 | European Pat. Off. . | |
| 0552808 | 7/1993 | European Pat. Off. . | |
| 3341976 | 5/1985 | Germany . | |
| 0148355 | 11/1980 | Japan | 378/131 |
| 2038539 | 7/1980 | United Kingdom | 378/131 |
| 9308587 | 4/1993 | WIPO . | |

OTHER PUBLICATIONS

Patent Abstracts of Japan, vol. 4, No. 117 (E–022) Aug. 20, 1980 & JP–A–55 072 351 (Toshiba Corp) May 31, 1980.

*Primary Examiner*—David P. Porta

*Attorney, Agent, or Firm*—Cushman Darby & Cushman

[57] ABSTRACT

In an X-ray tube apparatus of a rotating anode type, a stator surrounds an anode rotary structure and an insulating container section placed around the outer periphery of a stationary structure such that a portion of its coil conductor located near the anode target side constitutes an expanding flared coil conductor portion. Therefore, it is possible, for the X-ray tube equipped with an envelope having a large-diameter metal section and small-diameter insulating container section, to shorten the axial length from an anode target of the X-ray tube to a far end of the rotary structure and to suppress the build-up of electric charges on the inner surface of the insulating container section.

6 Claims, 5 Drawing Sheets

X-RAY TUBE APPARATUS OF A ROTATING ANODE TYPE

BACKGROUND OF THE INVENTION

1. Field of the Invention

The present invention relates to an X-ray tube apparatus of a rotating anode type and, in particular, an improvement in the structure of a rotating anode type X-ray tube as a vacuum container equipped with a metal container section for receiving an anode target, in the structure of an X-ray tube holding housing for holding the rotating anode type X-ray tube and in the structure of a stator for rotational drive.

2. Description of the Related Art

As is well-known in the prior art, the rotating anode type X-ray tube is mounted within an X-ray tube holding housing filled with an insulating oil. The X-ray tube apparatus of a rotating anode type is equipped with a stator of an electromagnetic induction motor for rotating the X-ray tube at high speeds. The stator above is comprised of an iron core/coil conductor-combined unit and located near the outer periphery of a vacuum envelope for housing the rotary structure in the X-ray tube corresponding to a rotor of the motor.

As shown in FIG. 1, the stator 13 is constructed by a stator coil conductor 12 wound along a number of slits formed in a cylindrical iron core 11, that is, a core comprised of stacked thin sheet rings made of a ferromagnetic material. On the other hand, the X-ray tube 14 is equipped, with a glass container section 17 of a vacuum envelope 16 surrounding a rotary structure 15. A disc-like anode target 19 is arranged in the vacuum envelope 16 at a metal container section 18 of a large diameter. The anode target 19 is fixed by a rotation shaft 20 to the rotary structure 15 and supported there. The rotary structure 15 is rotatably held on a stationary structure 21 by bearing means not shown. In FIG. 1, reference numeral 18*a* denotes a corona ring extending from the metal container section; 17*a*, an expanding flared section of the glass container section; and 17*b*, a small-diameter cylindrical section of the glass container section.

The stator 13 is arranged near the outer periphery of the small-diameter cylindrical section 17*b* of the glass container section. A rotation magnetic field is generated mainly on the inside of the iron core 11, acting upon the rotary structure 15 and hence rotating the rotary structure at high speeds.

With the conventional X-ray tube apparatus having a structure as shown in FIG. 1, the coil conductor 12 of the stator 13 linearly extends toward the anode target side and the ion core 11 is relatively spaced far apart from the anode target 19. From the structural and operational condition of the X-ray tube apparatus, usually, the metal container section 18 of the vacuum container (envelope) is held at a ground potential and a high positive voltage of, for example, 75 kV is applied to the anode target 19. For this reason, an interval G between the anode target 19 and the metal container section 18 of the vacuum container is maintained at a distance enough great to withstand such a high voltage difference during operation.

The axial distance H from the lower end of the anode target 19 to that of the rotary structure 15 is 10 increased to an undesired extent. Further, the iron core 11 of the stator 13, together with the X-ray tube holding housing, is connected to a ground potential and the iron core and the coil conductor are substantially connected to the ground D.C. potential, even if an AC drive voltage is applied to a coil conductor 12 at the operation of the X-ray tube apparatus. During the operation of the X-ray tube apparatus, a great potential gradient is involved on the inner surface of the expanding flared section 17*a* of the glass container section due to a potential distribution created between the inside corner portion of the upper end of the stator 13 and the rotary structure in the X-ray tube. Floating electrons e entering into the space between the corona ring 18*a* and the rotary structure 15 reach the inner surface of the expanding flared section 17*a* which is charged up by the floating electrodes. This may develop an undesired discharge.

SUMMARY OF THE INVENTION

It is an object of the present invention to provide an X-ray tube apparatus of a rotating anode type which can shorten an axial distance from the lower end of an anode target to the lower end of a rotary structure to provide a compact unit and can suppress the build-up of electric charges on the inner surface of an expanding flared section of an insulating container section to prevent an occurrence of a discharge there.

According to the present invention an X-ray tube apparatus of a rotary anode type is provided in which a stator's coil conductor portion on the anode target side is expanded along an expanding flared section of the insulating container section.

With the X-ray tube apparatus of the rotating anode type, an axial distance of the tube from the lower end of the anode target to the lower end of its rotary structure can be shortened to provide a compact unit and it is possible to suppress electric charges from being accumulated on the inner surface of the expanding flared section of the insulating container section resulting from an action of an electromagnetic field by the expanding section of the stator's coil structure and to thereby ensure a stable operation, while achieving less discharge.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

Figure 1:
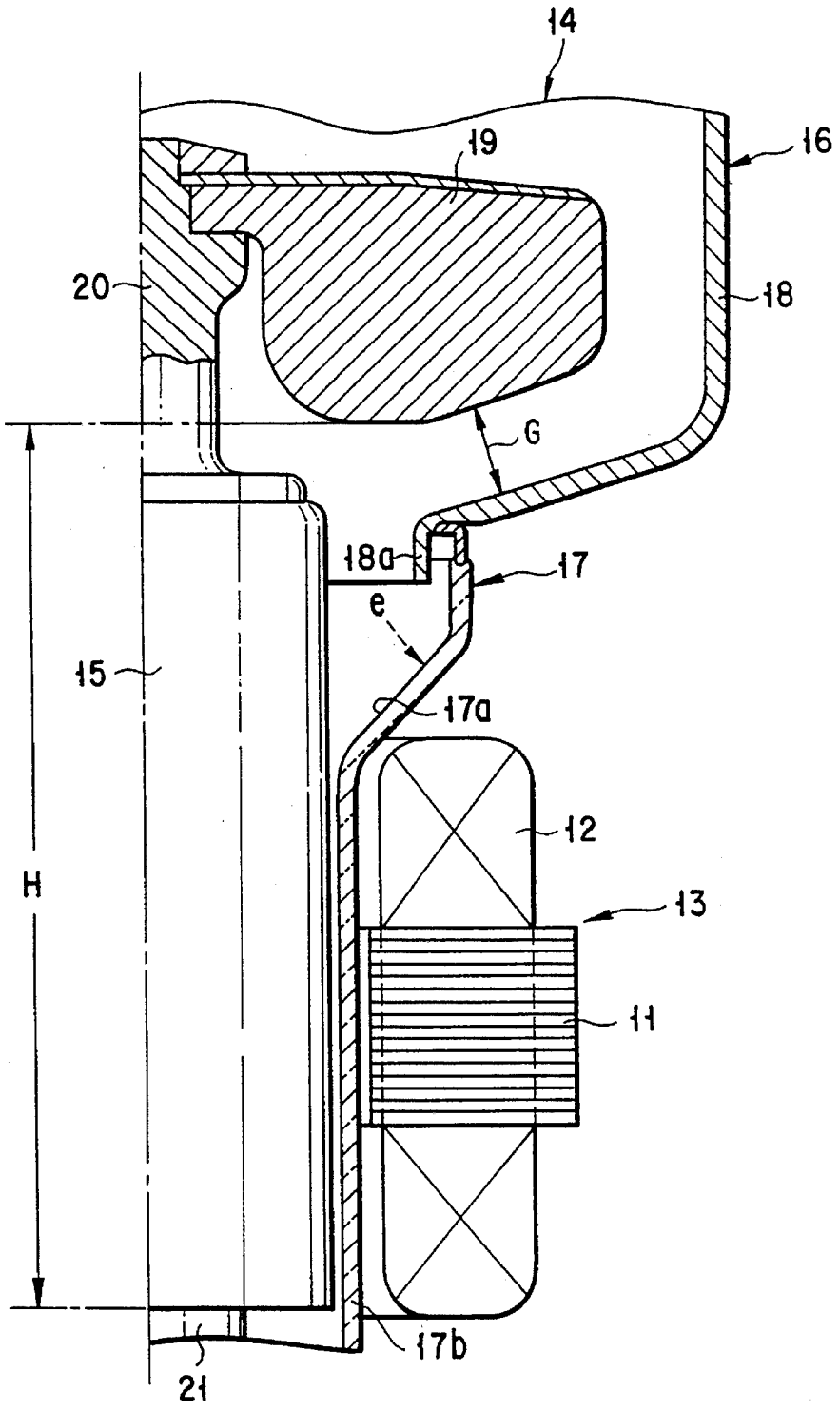
FIG. 1 (PRIOR ART)
FIG. 1 is a cross-sectional view, partly cut away, diagrammatically showing part of a structure of a conventional X-ray tube apparatus.

An X-ray tube apparatus according to one embodiment of the present invention will be explained below with reference to FIGS. 2 to 5. Throughout the drawings, the same reference numerals are employed to designate the same parts or elements. The X-ray tube apparatus according to the embodiment of the present invention has the following structure. That is, a holding housing 22 for holding an X-ray tube 14 of a rotating anode type is filled with an insulating oil and the end portion of a stationary structure 21 of the X-ray tube is fixedly threaded to an insulating support frame 29 within the X-ray tube holding housing 22, the support frame 29 being made of, for example, plastics. Within the holding housing 22 a stator 23 is fixedly held on a support angle 24 and insulating support frame 29. Further, the holding housing 22 has a shielding lead layer 25 lined with a lead and a connection terminal 26 connected to a high-tension cable.

Figure 2:
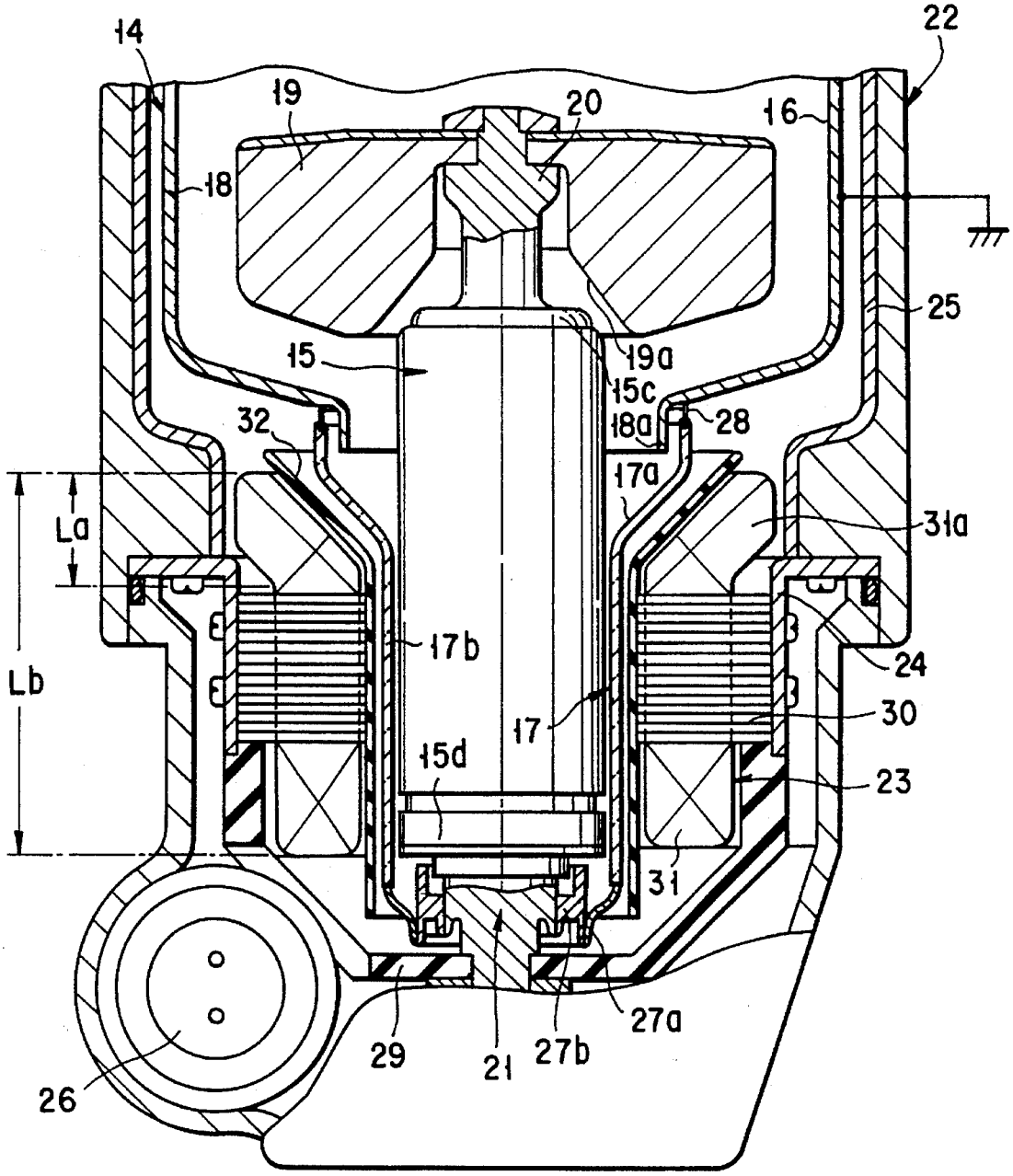
FIG. 2 is a cross-sectional view, cut away, diagrammatically showing a major section of an X-ray tube apparatus of a rotating anode type according to an embodiment of the present invention.
Figure 3:
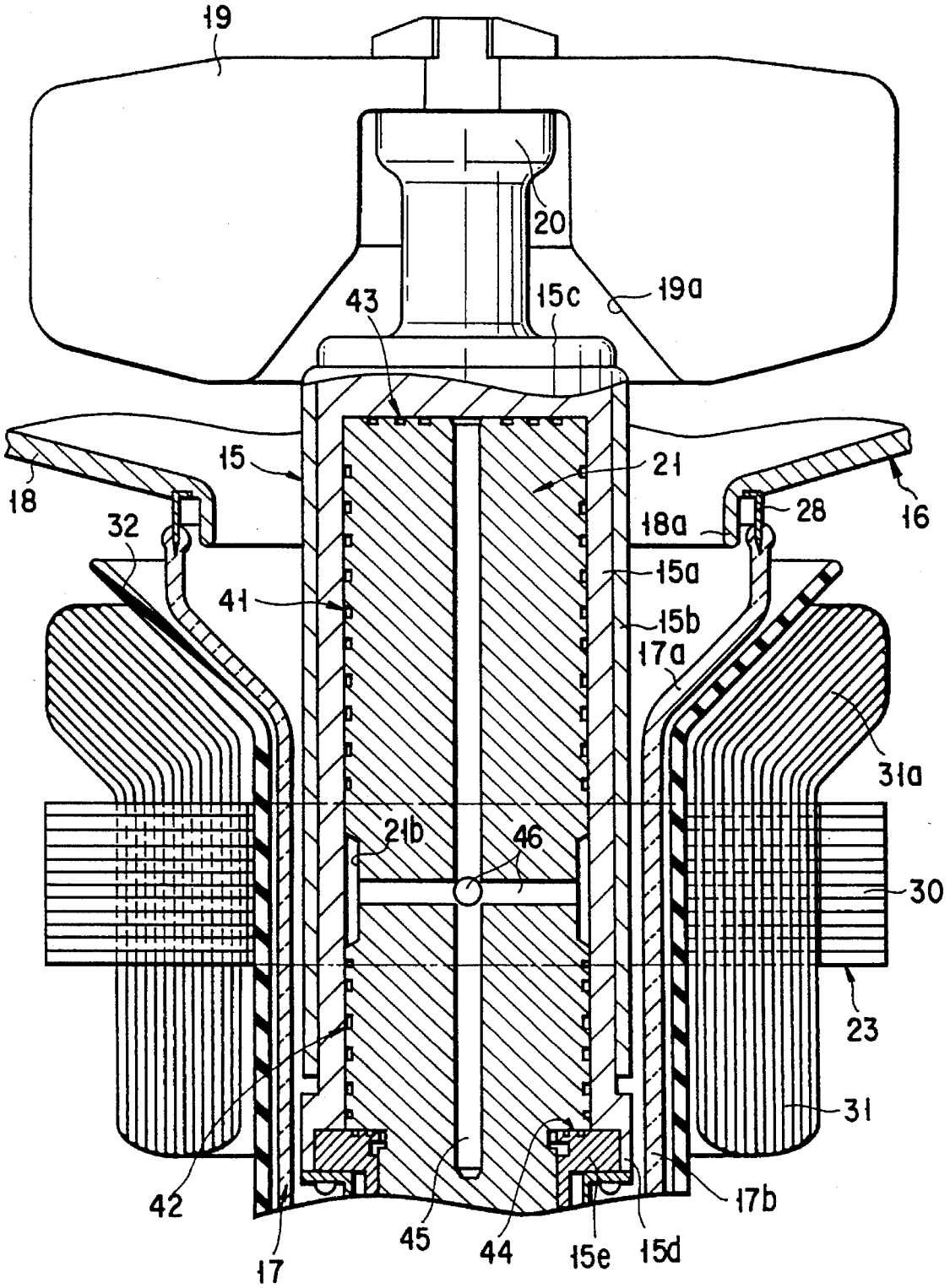
FIG. 3 is an expanded, cross-sectional view, partly cut away, showing a major section of the apparatus of FIG. 2.

In the X-ray tube 14, a disc-like anode target 19 made of a heavy metal is arranged in a metal container section or a large-diameter section 18 of a vacuum container or envelope 16 and the anode target 19 is fixed to a rotation shaft 20 which is in turn fixed by the rotation shaft 20 to a cylindrical rotary structure 15. The rotary structure 15 is rotatably fitted into the stationary structure 21 through bearing means. The end portion of the metal container section 18 of the vacuum container 16 extends substantially along the curved surface of an outer periphery of the target 19 and has its diameter reduced gradually and a corona ring 18*a* is provided at the lower end. The rotary structure 15 is received in an insulating container section 17 made of glass. As shown in FIGS. 2 and 3, the insulating container section 17 has an outwardly expanding flared section 17*a* on the target side and an upper end section extending along the outer periphery of the corona ring 18*a* and joined to the lower end of the metal container section 18 by a sealing metal ring 28. The insulating container section 17 has a small-diameter cylindrical section 17*b* straightly extending in a close proximity relation to the outer periphery of the rotary structure 15. The small-diameter cylindrical section 17*b* has its lower end welded, in a hermetically sealing way, to the outer peripheral portion of the anode stationary structure 21 by a sealing metal ring 27*a* and auxiliary metal ring 27*b*.

As shown in FIG. 3, the cylindrical rotary structure 15 has a ferromagnetic cylindrical section 15*a* made of iron or hard iron alloy and a cylindrical section 15*b* fixed to the outer periphery of the cylindrical section 15*a* and made of a good conduction such as copper or copper alloy. A shoulder 15*c*, on the shaft-side, of the cylindrical section is positioned in an inside space of a central recess 19*a* in a rear surface side of the anode target 19. Further, a thrust ring 15*e* made of iron or iron alloy is fixed to an open end section 15*d* of the rotary structure 15 by a plurality of screws.

Figure 4A:
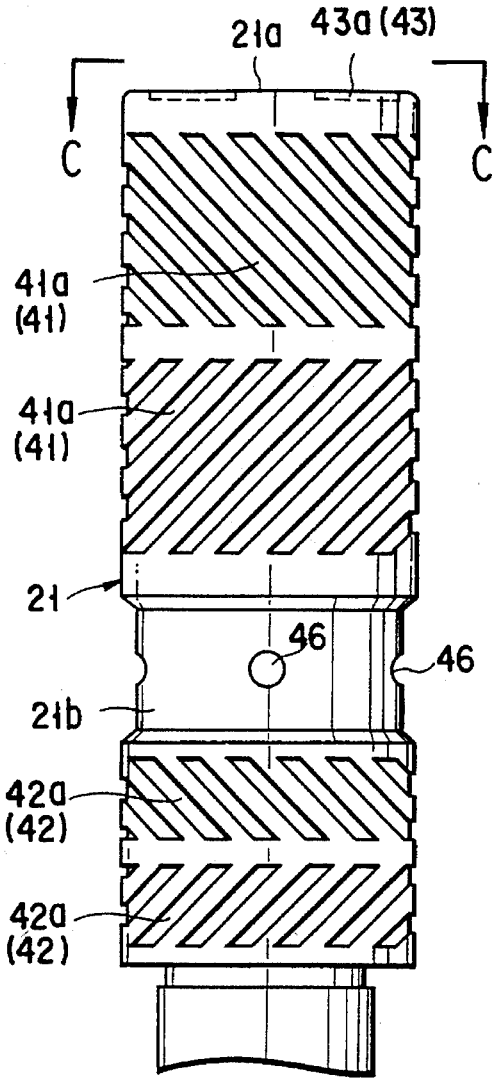
FIG. 4A is a side view showing a stationary structure in FIG. 2.

Two sets of dynamic pressure bearings, radial slide bearings 41, 42 and thrust slide bearings 43, 44, are provided at those fitting portions between the rotary structure 15 and the stationary structure 21. The two radial slide bearings 41, 42 are provided in a spaced-apart relation to the axial direction of the rotation shaft and have two sets of herringbone pattern spiral grooves 41*a*, 42*a* provided in the outer peripheral surface of the stationary structure 21 as shown in FIG. 4A. The spiral groove 41*a* is located near the anode target and has a length about double that of the other spiral groove 42*a* along the axial direction of the rotation shaft and hence has a relatively greater bearing-withstand load capability. A small-diameter section 21*b* of the stationary structure 21 is provided at an intermediate area between the spiral grooves 41*a* and 42*a*. The stationary structure 21 is made of a hard iron alloy.

Figure 4C:
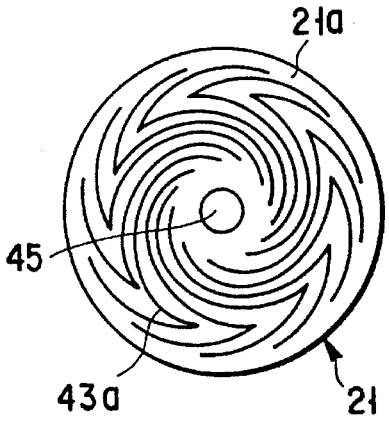
FIG. 4C is a top view showing a bearing as viewed along line C—C in FIG, 4.
Figure 4B:
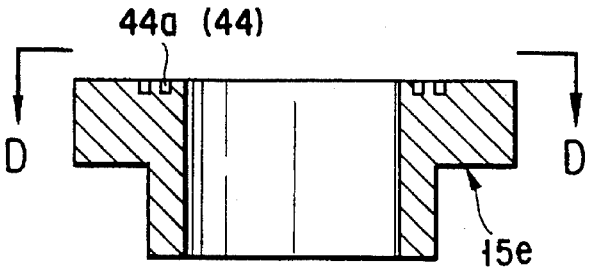
FIG. 4B is a cross-sectional view, partly cut away, showing a thrust ring in FIG. 2.
Figure 4D:
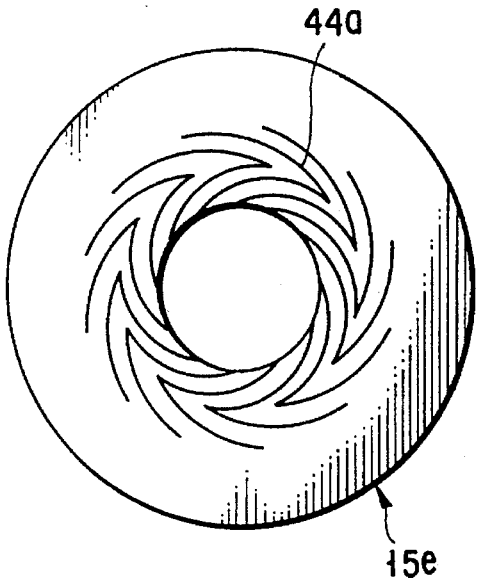
FIG. 4D is a top view showing a bearing as viewed along line D—D in FIG. 4.

The thrust slide bearing 43 has circular herringbone pattern-like spiral grooves on the end surface 21*a* of the anode stationary structure as shown in FIG. 4C while, on the other hand, the thrust slide bearing 44 has a circular herringbone pattern-like spiral grooves 44*a* provided on the upper surface of the thrust ring 15 placed in contact with a step surface of the lower portion of the stationary structure. The slide bearing surfaces contacting with the associated spiral-grooved bearings may be provided as simply flat surfaces or spiral-grooved surfaces as required. It is to be noted that the bearing surfaces of the rotary structure and stationary structure are such that a gap of about 20 μm is maintained relative to these bearings during the rotation operation of the apparatus.

The stationary structure 21 has a lubricant holding chamber 45 bored in a direction of its center axis as shown in FIG. 4C and a lubricant passage 46 pierced through the small-diameter section 21*b* in a crisscross relation as shown in FIG. 4A. A liquid metal lubricant, not shown, such as a gallium/indium/tin-based alloy is applied into the respective spiral grooves, bearing gaps, lubricant holding chamber and lubricant passage, noting that it becomes a liquid during operation.

Figure 5:
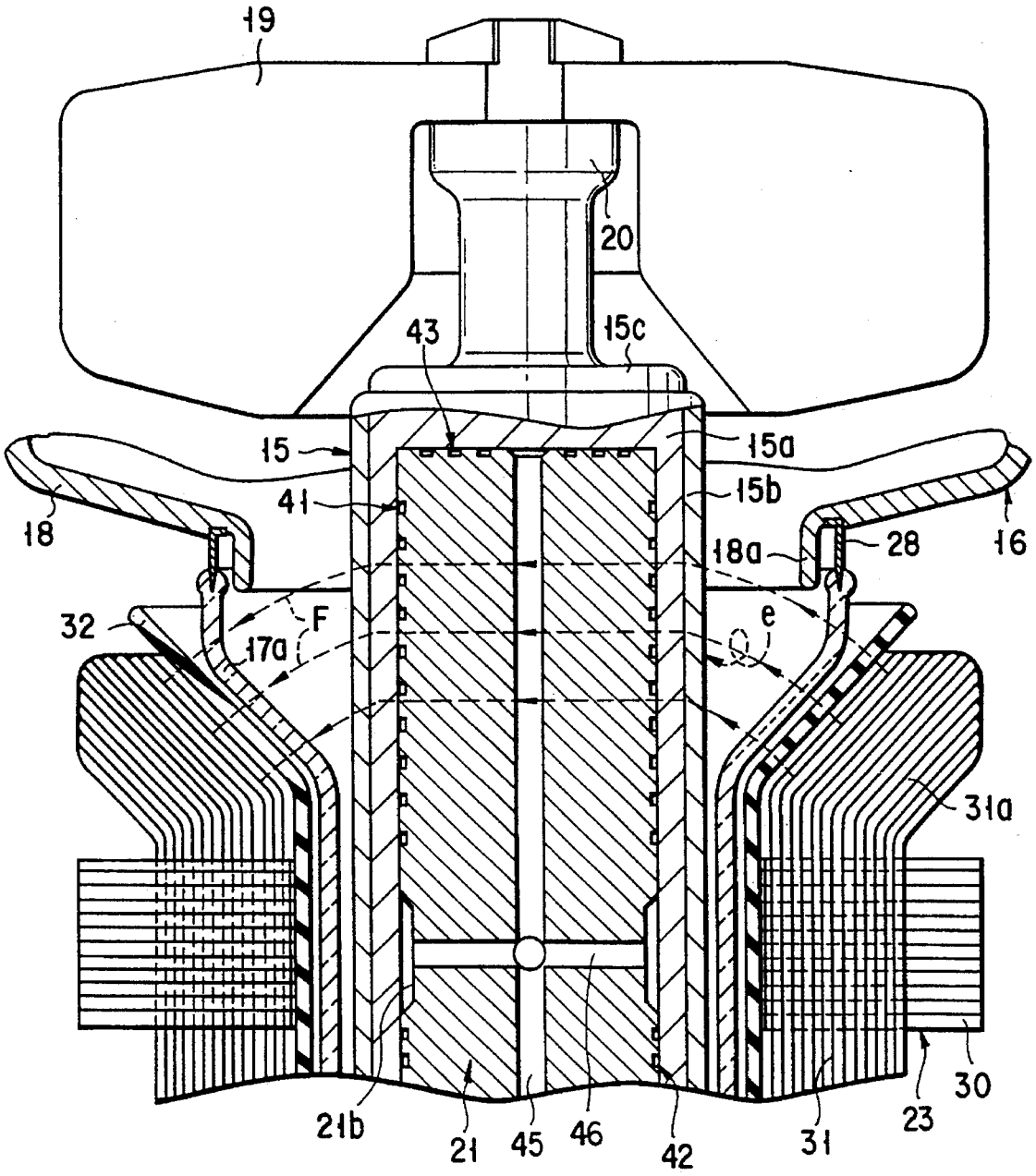
FIG. 5 is an expanded cross-sectional view partly cut away, for explaining the effects of the embodiment of FIG. 2.

As shown in FIGS. 3 and 5, the stator 23 has a coil conductor 31 arranged along a number of axial slits provided on the inside of a circular iron core 30 and turned at the upper and lower sides. A coil conductor section, in particular, on the metal container side has an expanding flared coil conductor section 31*a*. In the case of this embodiment, the coil conductor expanding section 31*a* is externally flared along the expanding flared section 17*a* of the insulating container section. The axial length La of the flared coil conductor section 31*a* is determined to be greater than 20% of the axial length Lb of the stator 23. The practical upper limit is set to be about 60%. Further, the flared coil conductor section 31*a* may be of such a type that it is expanded in a lateral direction substantially at right-angle relation or it has its inner coil surface only expanded in a flared way.

An insulating cylindrical member 32 made of plastics is interposed between the stator 23 and the insulating container section 17 so as to enhance electrical insulation. The anode target-side portion of the insulating cylindrical member 32 is expanded, as an expanding flared portion, along the expanding flared section 17*a* of the insulating container section and extends further outwardly than the forward end of the expanding flared coil conductor section 31*a*.

The stator has its iron core 30 provided preferably at an intermediate area between the two radial slide bearings 41 and 42, that is, in a position substantially corresponding to the small-diameter section 21*b* of the stationary structure. By doing so, a rotation magnetic field created by the stator is not exerted on the major portion of the spiral grooves of the respective dynamic pressure type slide bearing, thus alleviating undesirable causes, such as the generation of unwanted heat or the promotion of a chemical reaction produced in the liquid metal lubricant. This proves effective to maintain a stable bearing operation.

In this way, the anode target-side coil conductor of the stator is laterally expanded along the expanding flared section 17*a* of the insulating container section and in a relatively close proximity relation to the latter, so that the stator can be located near the anode target side. As a result, the axial distance (corresponding to a dimension H in FIG. 1) from the lower end, that is, the rear end side, of the anode target to the lower end of the rotary structure can be shortened to provide a compact unit. Further, the expanding flared coil conductor section 31*a* constitutes a conductor of a substantial ground potential, thus leading to the alleviation of a potential gradient at its neighboring insulating container section, in particular, at the inner surface of the expanding flared section, and hence to the suppression of the charging of floating electrons. Further, a rotation magnetic field created from the expanding flared coil conductor section of the stator is much weaker than that generated from the iron core, but, as indicated by reference symbol F in FIG. 5, it is bulged toward the anode target side, passes through the rotary structure and stationary structure and reaches a reverse side. Even if, therefore, floating electrons e enter into space between the corona ring of the metal container section and the anode rotary structure, they reach the outer peripheral surface of the rotary structure (anode potential), while being rotated around the magnetic flux as indicated by a dotted line in FIG. 5, due to both the leakage fields F and electric field distribution in that space, so that they are caught there. Even from this it is also possible to suppress the charging of electrons on the insulating container section, in particular, on its expanding flared inner surface and hence to suppress any discharge resulting therefrom.

It is to be noted that the bearing may be comprised of not only the above-mentioned dynamic pressure type bearing but also a ball bearing or their combination.

As explained above, according to the X-ray tube apparatus it is possible to shorten the axial distance from the lower end of the anode target to the lower end of the rotary structure and hence to provide a compact apparatus. It is also possible to suppress the charging of electrons on the inner surface of the insulating container section and hence to achieve the suppression of a resultant discharge and to obtain a stable operation.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An X-ray tube apparatus of a rotating anode type, comprising:

(1) a rotary anode type X-ray tube including
  (a) a disc-like anode target,
  (b) a rotary structure to which the anode target is fixed,
  (c) a stationary structure for supporting the rotary structure,
  (d) bearing means, provided between the rotary structure and the stationary structure, for rotatably bearing the rotary structure around the stationary structure, and
  (e) an envelope having a large-diameter metal container section and a small-diameter insulating container section having an expanding flared end portion and hermetically joined to the metal container section, the disc-like anode target being arranged within the metal container section and the rotary structure and stationary structure being received in the insulating container section;

(2) an X-ray tube holding housing for holding the X-ray tube therein; and (3) a cylindrical stator comprised of an iron core and coil conductor wound around the iron core, the iron core and coil conductor surrounding the rotary structure of the X-ray tube and insulating container section of the envelope within the X-ray tube holding housing and the cylindrical stator having its coil conductor portion located near the metal container section and expanded substantially along the expanding flared end section of the insulating container section, wherein an axial length defined on the expanding flared section of the coil conductor is greater than 20% of an axial length of the stator.

2. The apparatus according to claim 1, wherein the bearing means comprises dynamic pressure slide bearings having spiral grooves applied with a liquid metal lubricant.

3. The apparatus according to claim 1, wherein the bearing means comprises two dynamic pressure slide bearings spaced apart in an axial direction of the X-ray tube and having spiral grooves applied with a liquid metal lubricant and the core of the stator is located in an area between the two slide bearings.

4. An X-ray tube apparatus of a rotating anode type, comprising:

(1) a rotary anode type X-ray tube including
  (a) a disc-like anode target,
  (b) a rotary structure to which the anode target is fixed,
  (c) a stationary structure for supporting the rotary structure,
  (d) bearing means, provided between the rotary structure and the stationary structure, for rotatably bearing the rotary structure around the stationary structure, and
  (e) an envelope having a large-diameter metal container section and a small-diameter insulating container section having an expanding flared end portion and hermetically joined to the metal container section, the disc-like anode target being arranged within the metal container section and the rotary structure and stationary structure being received in the insulating container section;

(2) an X-ray tube holding housing for holding the X-ray tube therein; and (3) a cylindrical stator comprised of an iron core and coil conductor wound around the iron core, the iron core and coil conductor surrounding the rotary structure of the X-ray tube and insulating container section of the envelope within the X-ray tube holding housing and the cylindrical stator having its coil conductor portion located near the metal container section and expanded substantially along the expanding flared end section of the insulating container section, wherein the anode target has a recess and the rotary structure has a shoulder portion located in a recess of the anode target.

5. The apparatus according to claim 4, wherein the bearing means comprises dynamic pressure slide bearings having spiral grooves applied with a liquid metal lubricant.

6. The apparatus according to claim 4, wherein the bearing means comprises two dynamic pressure slide bearings spaced apart in an axial direction of the X-ray tube and having spiral grooves applied with a liquid metal lubricant and the core of the stator is located in an area between the two slide bearings.

* * * * *